US006039369A

United States Patent [19]

Stahovic

[11] Patent Number: 6,039,369

[45] Date of Patent: Mar. 21, 2000

[54] ANIMAL EXCREMENT COLLECTING DEVICE AND COLLECTING TOOL

[76] Inventor: Robert Stahovic, 708 Venango Ave., Apt. 9, Cambridge Springs, Pa. 16403

[21] Appl. No.: 09/070,074

[22] Filed: Apr. 30, 1998

[51] Int. Cl.[7] ..... A01K 1/01

[52] U.S. Cl. ..... 294/1.4; 15/257.2

[58] Field of Search ..... 294/1.3–1.5, 51, 294/55, 58; 248/99, 101; 15/257.1, 257.2, 257.3, 257.6, 257.7; D30/162

[56] References Cited

U.S. PATENT DOCUMENTS

| | | | |
|---|---|---|---|
| D. 406,415 | 3/1999 | Martin | D30/162 |
| 1,120,062 | 12/1914 | Krabill . | |
| 1,158,335 | 10/1915 | Upton . | |
| 1,167,491 | 1/1916 | Gilson, Sr. . | |
| 1,578,532 | 3/1926 | Legorio | 294/51 |
| 2,307,448 | 1/1943 | Bouton | 56/400.05 |
| 2,314,685 | 3/1943 | Brooke | 30/315 |
| 2,840,414 | 6/1958 | Beau | 294/51 |
| 3,344,863 | 10/1967 | Hastings | 172/41 |
| 3,668,850 | 6/1972 | Horkey | 56/400.04 |
| 3,688,483 | 9/1972 | Hamilton | 294/55 |
| 4,148,513 | 4/1979 | Gangne | 15/257.1 |
| 4,196,928 | 4/1980 | Spangler | 294/55 |
| 4,279,437 | 7/1981 | Goldbarg | 294/1.4 |
| 4,476,939 | 10/1984 | Wallace | 172/374 |
| 4,565,398 | 1/1986 | Paulin | 294/52 |
| 4,901,801 | 2/1990 | Popivalo | 294/51 |
| 4,974,893 | 12/1990 | Grahn | 294/1.3 |
| 5,064,233 | 11/1991 | Sloan | 294/1.3 |
| 5,205,122 | 4/1993 | Wong | 56/400.04 |
| 5,269,575 | 12/1993 | Parvaresh | 294/1.5 |
| 5,385,376 | 1/1995 | Malaspina et al. | 294/1.3 |
| 5,476,296 | 12/1995 | Gross | 294/1.3 |
| 5,540,470 | 7/1996 | Lu | 294/104 |
| 5,564,762 | 10/1996 | Ring | 294/1.3 |
| 5,579,812 | 12/1996 | Bigwood | 141/109 |
| 5,584,519 | 12/1996 | Myles et al. | 294/1.3 |
| 5,620,221 | 4/1997 | Wilke | 294/1.5 |
| 5,634,678 | 6/1997 | Bailey | 294/1.5 |
| 5,671,959 | 9/1997 | Tsou | 294/1.4 |

*Primary Examiner*—Dean J. Kramer
*Assistant Examiner*—Paul T. Chin
*Attorney, Agent, or Firm*—Lovercheck and Lovercheck

[57] ABSTRACT

A collecting device and a collecting tool for gathering animal feces matter comprising a flat member having a chute therethrough, a bag positioning member is fixed to the bottom of the flat member and bag securing members fixed to each of the flat member. The collecting tool has a scraping blade to gather feces matter from clear surfaces and a rake to gather feces matter from grass and other growth covered surfaces. The handles each have a flat side to facilitate carrying the device and tool in one hand.

16 Claims, 2 Drawing Sheets

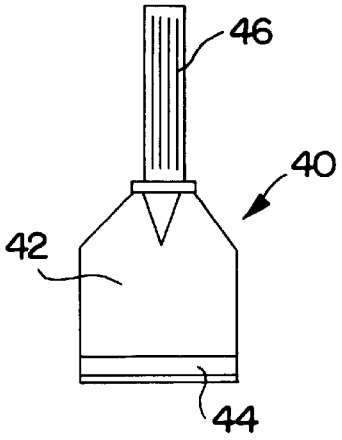
FIG. 6
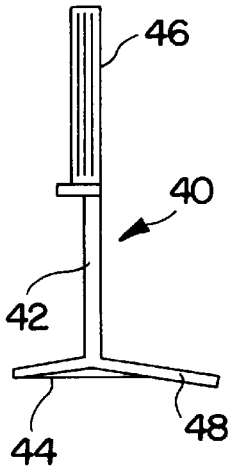
FIG. 7
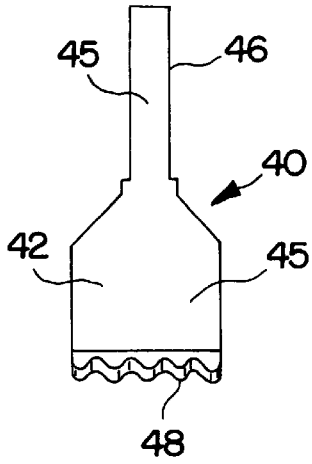
FIG. 8
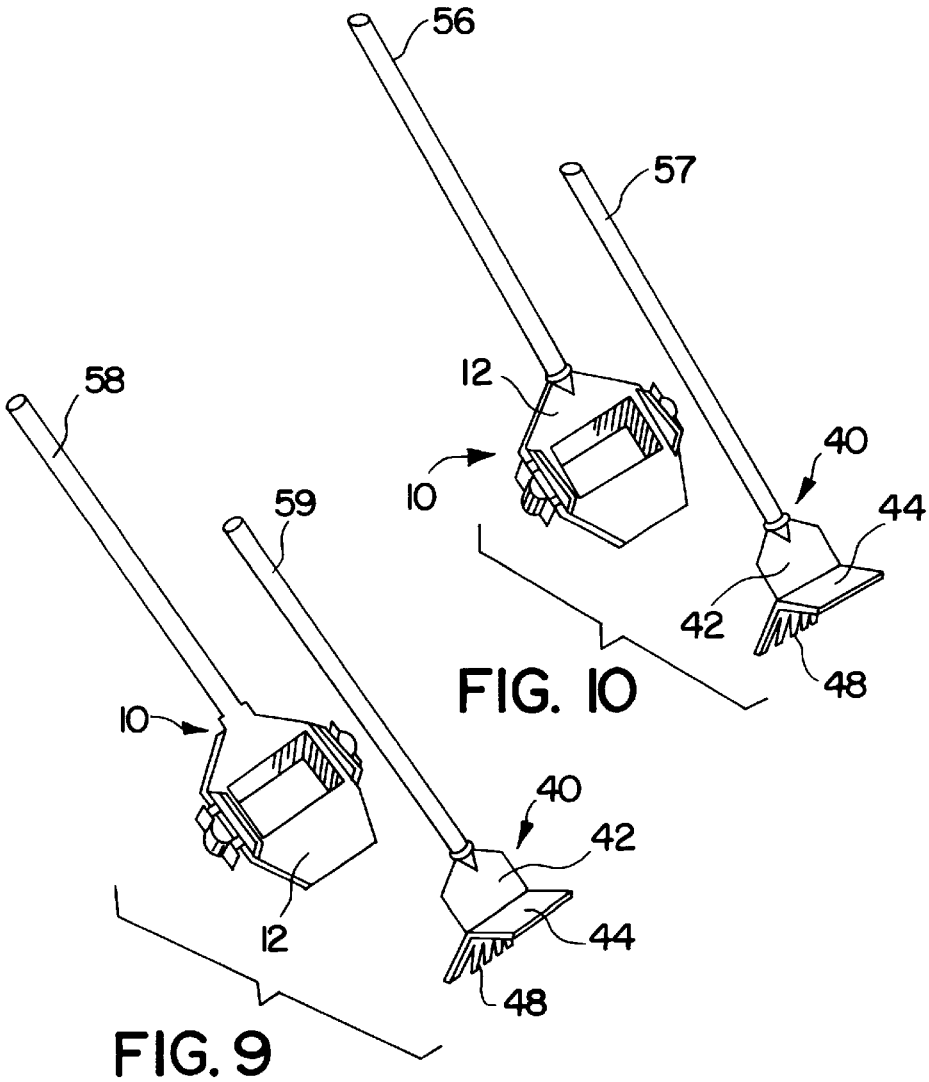
FIG. 10
FIG. 9

ANIMAL EXCREMENT COLLECTING DEVICE AND COLLECTING TOOL

BACKGROUND OF THE INVENTION

The present invention relates to collecting devices, and more specifically, to a collecting device and a collecting tool structure used to collect animal feces in a safe, sanitary and convenient manner.

Numerous feces pick up devices have been provided in the prior art. These devices are adapted to collect and dispose of animal feces that are deposited on the ground.

A large number of patents have been granted on this subject matter including the following U.S. Pat. Nos.: 1,120,062; 1,158,335; 1,167,491; 2,307,448; 2,314,685; 3,344,863; 3,668,850; 4,565,398; 4,476,939; 4,974,893; 5,064,233; 5,205,122; 5,269,575; 5,385,376; 5,476,296; 5,540,470; 5,564,762; 5,579,812; 5,584,519; 5,620,221; and, 5,634,678.

Each of these units may be suitable for the particular purpose to which they address, but each has disadvantages as well. Included in the above is U.S. Pat. No. 5,269,575 wherein K. Parvaresh discloses a flat tray with a small slot in the middle and an elongated handle having a hand grip at the upper end. A disadvantage of this structure is to position the plastic bag under the dog at the critical moment so that the feces can be deposited directly in the plastic bag.

The present invention is overcoming the disadvantages of this structure and provides additional advantages.

SUMMARY OF THE INVENTION

A collecting device and a collecting tool for gathering animal fecal matter that has been deposited on the ground comprising a flat member having a chute therethrough, a bag positioning member fixed to the flat member below the chute, and bag securing members fixed to each side of the flat member. A collecting tool has a scraping blade to gather fecal matter from unobstructed surfaces and a rake to gather fecal matter from grass and other growth covered surfaces. The handles each have a flat side to facilitate carrying the device and tool in one hand.

It is an object of the present invention to provide an improved portable sanitation device which is capable of being operated in simple manner by a person who can by means of the device efficiently collect and disposed of fecal matter and the like.

It is another object of the present invention to provide an improved collecting device, which employs disposable bags, which are simply and firmly attached and easily removed.

It is another object of the present invention to provide an excrement collector and rake structure that is simple in construction, economical to manufacture and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

BRIEF DESCRIPTION OF THE DRAWING(S)

FIG. 6 is a top view of the collecting tool showing the flat tool member and the blade collecting surface.

FIG. 7 is a side view of the collecting tool showing the scrapping tool and the collecting tool extending outwardly from the flat member.

FIG. 8 is a bottom view of the collecting tool showing the collecting teeth extending outwardly from the flat tool member.

FIG. 9 is a perspective top view of a long handled collecting device and a long handled collecting tool with the handle having a flat side to fit together for easy hand carrying.

FIG. 10 is a perspective top view of a long full round handled collecting device and a long full rounded handle collecting tool according to one embodiment of the invention.

DESCRIPTION OF THE PREFERRED EMBODIMENT(S)

Figure 1:
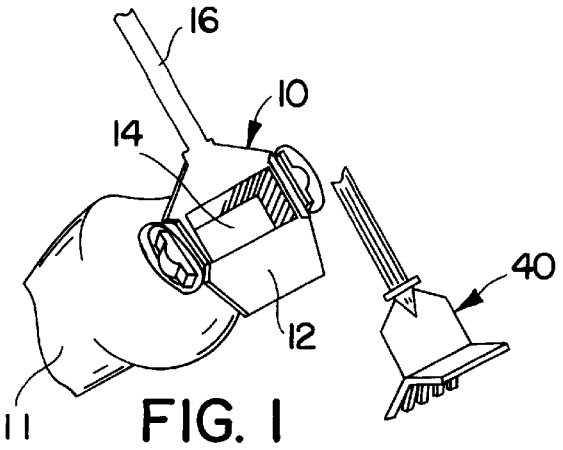
FIG. 1 is a perspective view of a collecting device with bag attached and a collecting tool for gathering animal feces according to the invention.
Figure 2:
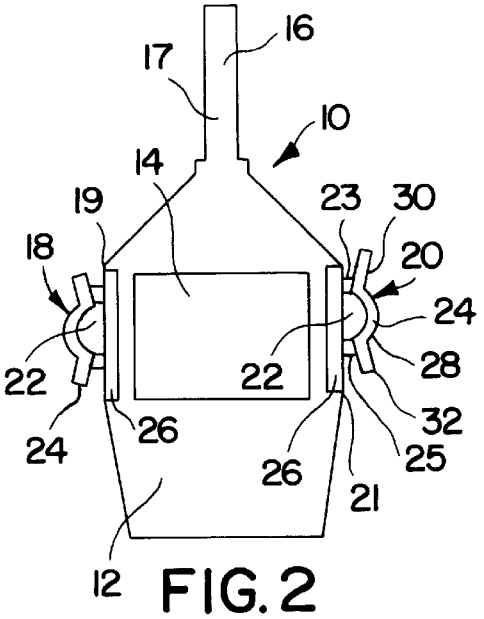
FIG. 2 is a top view of the collecting device showing the handle, flat member, the chute extending through the flat member and bag securing structure according to the invention.
Figure 3:
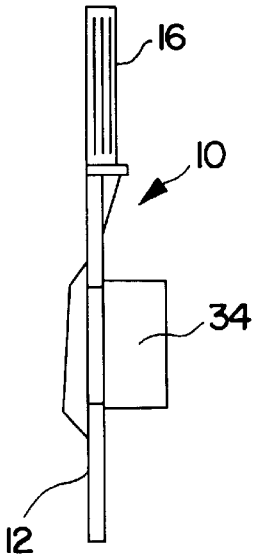
FIG. 3 is a side view of the collecting device showing the bag positioning member on the bottom of the flat member, and the guide members on the top side of the flat member according to the invention.
Figure 4:
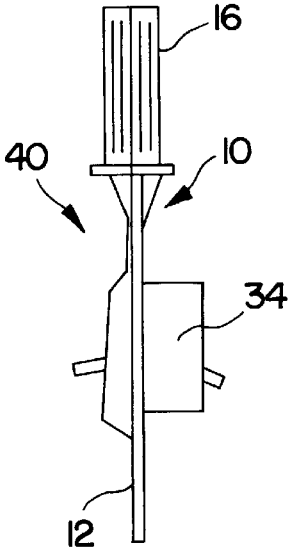
FIG. 4 is a side view of the collecting device and the collecting tool in a carrying position with the flat sides of the handles and flat members placed adjacent each other and side to flat handle side, the raking tool extending through the chute and bag positioning member of the collecting device.
Figure 5:
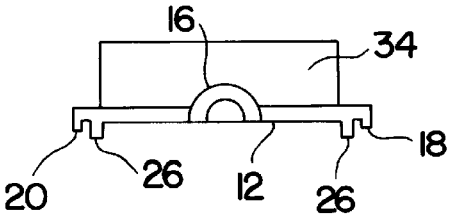
FIG. 5 is an inverted handle end view of the collecting device according to the invention.

Now with more particular reference to the drawings, shown is collecting device 10 is shown in FIG. 1 with bag 11 releasably attached and in FIGS. 2 through 5. Collecting device 10 comprises flat member 12 having a top and bottom. Chute 14 extending through flat member 12 from the top to the bottom thereof. Handle 16 is attached to flat member 12 at an end thereof. Handle 16 is adapted to be engaged by a person's hand while using collecting device 10. Handle 16 may be semi-circular with a flat surface on handle side 17. Handle side 17 lies in a common plane with the upper surface of flat member 12. First bag securing member 18 is attached to first side 19 of flat member 12. Second bag securing member 20 is attached adjacent second side 21 of flat member 12. Each of the first and second bag securing members has passage 22 formed between outer member 24 and inner member 26. Outer member 24 and inner member 26 are supported in spaced relationship by first and second cross members 23, 25. Outer members 24 each have a curved central portion 28 which forms the outer side of passage 22. Passage 22 provides a space to pull a portion of the top of bag 11 through. When a portion of the top of the bag is pulled through the passage 22 on each side of the flat member, the bag 11 is pulled up tight to the bottom of flat member 12 and held open by bag positioning member 34. Outer members 24 each end in a first restricting portion 30 and a first end and a second restricting portion 32 at a second end. The restricting portions are angled to leave a wide gap between the restricting portion and inner member 26 at their outer most point and a narrow restricting gap at their inner point where they join with central portion 28. Thus, when a top portion of bag 11 is pulled through the passage 22, and wrapped around cross member 23 and around cross member 25, the first and second restricting portions secure the bag in a position to receive animal feces as it is collected onto flat member 12 and into chute 14 by collecting tool 40.

The underside of the collecting device has bag positioning member 34 which extends generally around chute 14 and holds the bag which is open, to receive animal feces which is restrained by the first and second bag securing members.

Collecting tool 40 has flat member 42 comprising a body thereof and has handle 46 fixed rigidly at an end thereof. Handle 46 may be semi-circular with flat side 45 that lies in a common plane with flat side 45 of handle 46. The distal end of flat member 42 ends in working surfaces extending outwardly from the end thereof. A first outwardly extending member comprises scraping tool 44 which is a solid blade member. The second outwardly extending member comprises raking tool 48 which is divided into teeth which are suitable for moving through grass and other growth to collect excrement onto the flat member of collecting device 10. The width of flat member 42 is less than the width of chute 14 so that when flat side 17 of handle 16 and flat side 45 of handle 46 are placed together, and the flat surface 43 of flat member 42 is positioned together with the flat surface of collecting device 10, the collecting device and the collecting tool nest together, the two half round handles form a round handle for convenient carrying of the collecting device and collecting tool and the racking tool teeth extend through the chute 14. As shown in FIGS. 9 and 10, the collecting device may be provided with long full round handle 56 and collecting tool 40 may be provided with a long full round handle 57. As shown in FIG. 9, collecting device 10 may be provided with a long half round handle 58 and collecting tool 40 may be provided with a long half round handle 59. These tools will fit together forming a full round long handle for carrying the two tool conveniently in the same manner as with the short handles 16, 46 with raking tool 48 extending through chute 14.

Thus, when using either short or long handled tools, collecting tool 40 is used to collect excrement onto flat member 12 of collecting device and into chute 14 where it will fall into bag 11 being positioned by bag positioning member 34 beneath chute 14. The bag can then be removed by unwrapping the bag ends from the first and second bag securing members. The bag may then be tied off and disgarded in a safe and convenient manner.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privlege is claimed are defined as follows:

1. A collecting device for the receipt of animal fecal matter comprising a handle, a generally flat member for the receipt of said fecal matter, and bag securing means;

said handle being attached to an end of said flat member and extending outwardly therefrom;

said flat member having a chute generally centrally disposed and extending therethrough;

said bag securing means being disposed at first and second sides of said flat members adjacent said chute;

a first and second bag securing means each comprises an inner member and an outer member spaced from each other and supported generally parallel to each other;

the first and second bar securing means each further comprise a restricting portion at each end of the outer member whereby a bag portion can be positioned therein and secured thereby;

the restricting portions comprise a portion of the outer member that extends at an acute angle relative to the inner member forming a wider gap at its outer extreme and a narrower gap at its inner extreme whereby a bag portion may be secured therein.

2. The collecting device recited in claim 1 further comprising a bag positioning member attached to the bottom surface of the flat member and extending generally around the chute and downwardly therefrom.

3. The collecting device recited in claim 1 wherein the first and second bag securing means each further comprise a passage between a center portion of the inner member and a center portion of the outer member.

4. The collecting device recited in claim 1 wherein the handle is semi-circular in cross section and has a flat side generally along its entire length.

5. The collecting device recited in claim 4 wherein the flat member has an upper surface;

the flat surface on the handle is aligned with the upper surface of the flat member.

6. The collecting device recited in claim 5 wherein the semi-circular handle with the flat side is long enough to permit a normal sized adult to use the collecting device without bending down.

7. A collecting tool for the gathering of animal fecal matter comprising a generally flat body member having a first end and a second end, a handle attached to the first end, the second end having a scraping tool extending outwardly therefrom in a first direction, the second end having a raking tool with rake teeth extending outwardly therefrom in a second direction;

the handle being semi-circular in cross section and having a flat side generally along its entire length; a collecting device comprising a handle, a generally flat member for the receipt of said fecal matter;

said handle having a flat side and being attached to an end of said flat member and extending outwardly therefrom;

said flat member having a chute extending therethrough;

said collecting device and said collecting tool can be placed flat side to flat side with the rake teeth of the collecting tool extending through a chute in the collecting device.

8. The collecting tool recited in claim 7 wherein the raking tool and the scraping tool are narrower than the chute in the collecting device.

9. The collecting tool recited in claim 8 wherein the flat member has an upper surface;

the flat surface on the handle is aligned with the upper surface of the flat member.

10. The collecting tool recited in claim 7 wherein the semi-circular handle with the flat side is long enough to permit a normal sized adult to use the collecting tool without bending down.

11. A collecting structure for the receipt of animal fecal matter comprising a collecting device and a collecting tool;

said collecting device comprises a handle, a generally flat member for the receipt of said fecal matter, and bag securing means;

said handle being attached to an end of said flat member and extending outwardly therefrom;

said flat member having a chute generally centrally disposed and extending therethrough;

said bag securing means being disposed at first and second sides of said flat members adjacent said chute;

said collecting tool comprises a generally flat body member having a first end and a second end, a handle attached to the first end, the second end having a scraping tool extending outwardly therefrom in a first direction, the second end having a raking tool extending outwardly therefrom in a second direction;

a first and second bag securing means each comprises an inner member and an outer member spaced from each other and supported generally parallel to each other;

the first and second bag securing means each further comprise a restricting portion at each end of the outer member whereby a bag portion can be positioned therein and, secured thereby;

the restricting portions comprise a portion of the outer member that extends at an acute angle relative to the inner member forming a wider gap at its outer extreme and a narrower gap at its inner extreme whereby a bag portion may be secured therein.

12. The collecting device recited in claim 11 further comprising a bag positioning member attached to the bottom surface of the flat member and extending generally around the chute and downwardly therefrom.

13. The collecting device recited in claim 11 wherein the first and second bag securing means each further comprise a passage between a center portion of the inner member and a center portion of the outer member.

14. The collecting device recited in claim 11 wherein the handle is semi-circular in cross section and has a flat side generally along its entire length.

15. The collecting tool recited in claim 11 wherein the raking tool and the scraping tool are narrower than the chute.

16. The collecting device recited in claim 14 wherein the semi-circular handle with the flat side is long enough to permit a normal sized adult to use the collecting device without bending down.

* * * * *